United States Patent [19]

Gilron

[11] 4,431,611

[45] Feb. 14, 1984

[54] MIXTURES OF ORGANIC PHOSPHONATES AND ANIONIC POLYMERS TO IMPROVE ACID EXTRACTION OF URANIUM

[75] Inventor: Jack L. Gilron, Chicago, Ill.

[73] Assignee: Nalco Chemical Company, Oak Brook, Ill.

[21] Appl. No.: 334,028

[22] Filed: Dec. 23, 1981

[51] Int. Cl.[3] ..... C22B 60/02

[52] U.S. Cl. ..... 423/20; 423/18

[58] Field of Search ..... 423/18, 20, 658.5, 10

[56] References Cited

U.S. PATENT DOCUMENTS

| | | | |
|---|---|---|---|
| 3,852,403 | 12/1974 | Booth | 423/20 X |
| 4,049,774 | 9/1977 | Harper et al. | 423/555 X |
| 4,141,854 | 2/1979 | Pavilicius et al. | 423/10 X |
| 4,200,337 | 4/1980 | Jackovitz et al. | 423/20 X |

*Primary Examiner*—Deborah L. Kyle
*Assistant Examiner*—Matthew A. Thexton
*Attorney, Agent, or Firm*—John G. Premo; Robert A. Miller; Donald G. Epple

[57] ABSTRACT

A method of improving the acid leaching of uranium ores which comprises adding to such ores while they are being leached between 0.01–2 lb. per ton of a composition comprising:

a. aminotris methylene phosphonic acid, and b. a water-soluble copolymer of vinyl sulphonic acid and acrylic acid combined in a weight ratio of from 2:1 to 1:2 and having a molecular weight within the range of from 500 to 100,000, with the weight ratio of a:b being within the range of 1:2 to 2:1.

2 Claims, No Drawings

MIXTURES OF ORGANIC PHOSPHONATES AND ANIONIC POLYMERS TO IMPROVE ACID EXTRACTION OF URANIUM

INTRODUCTION

In the processing of uranium-containing ores, they are ground and subjected to an acid leaching step. The most common acid leaching process is the so-called "acid process." This process is described in detail in Kirk-Othmer *Encyclopedia of Chemical Technology*, 2nd Edition, Volume 21, Inter-Science, 1970, page 13. As stated in this publication, "Typical leach reactions are the following:

$$6H_2SO_4+3MnO_2+3UO_2 \rightarrow 3UO_2SO_4+3MnSO_4+6H_2O$$

$$3H_2SO_4+NaClO_3+3UO_2 \rightarrow 3UO_2SO_4+NaCl+3H_2O$$

"In practice, the oxidation potential of the solution is determined by measuring the ferric to ferrous ratio. The role of ferric iron in the oxidation of tetravalent uranium is important. The internal reaction that makes possible the two oxidation reactions illustrated above involves the conversion of ferrous iron to ferric iron. The ferric iron then oxidizes the $UO_2$. The reaction (7) is probably taking the following course:

$$2Fe^{2+}+MnO_2+4H^+ \rightarrow 2Fe^{3+}+Mn^{2+}+2H_2O$$

$$UO_2+2Fe^{3+} \rightarrow UO_2^{2+}+2Fe^{2+}$$

"In most ores, sufficient iron is present for this reaction. It is necessary to add metallic iron to some ores to ensure an adequate supply of iron."

THE INVENTION

A method of improving the acid leaching of uranium ores which comprises adding to such ores while they are being leached between 0.01–2 lb. per ton of a composition comprising:

a. aminotris methylene phosphonic acid, and b. a water-soluble copolymer of vinyl sulphonic acid and acrylic acid combined in a weight ratio of from 2:1 to 1:2 and having a molecular weight within the range of from 500 to 100,000, with the weight ratio of a:b being within the range of 1:2 to 2:1.

THE AMINOTRIS METHYLENE PHOSPHONIC ACID

This material is prepared by reacting ammonia, formaldehyde, and phosphorus acid. This reaction is described in detail in Irani, U.S. Pat. No. 3,288,846. When used in the invention, this phosphonate is most preferably in the form of one of its water-soluble salts, preferably its sodium salt. It is available commercially in the form of a 50% aqueous solution of its sodium salt.

THE ACRYLIC ACID VINYL SULPHONIC ACID COPOLYMER

These polymers are prepared by copolymerizing acrylic acid and vinyl sulphonic acid, particularly sodium vinyl sulphonate. These copolymers may have a weight ratio varying between 1:1 to 2:1 with a preferred ratio of acrylic acid to vinyl sulphonic acid being about 1:0.45. These copolymers are difficult to prepare from the standpoint of producing high molecular weight species thereof. They usually have molecular weights a low as 500 with molecular weights rarely exceedin 100,000. A preferred material has a molecular weigh within the range of about 750 to about 50,000.

RATIO AND DOSAGE OF THE AMINOTRIS METHYLENE PHOSPHONIC ACID

The amount of aminotris methylene phosphonic aci in relation to the amount of acrylic acid vinyl sulphc nate copolymer may vary on a weight basis between 2: to 1:2 with a preferred ratio being about 1:1.

These materials are used to treat uranium slurries at dosage ranging from as little as 0.01–2 pounds per ton c slurry with a preferred dosage being within a range c 0.05–1 lb. per ton.

ILLUSTRATION OF THE INVENTION

Using a standard commercial ore, a composition hav ing the following makeup was tested:

FORMULATION I

| Ingredients | % by Weight |
|---|---|
| Sodium salt of acrylic acid/ vinyl sulfonate copolymer (25% in water) | 50 |
| 50% solution of $N(CH_2PO_3H_2)_3$ | 25 |
| 50% solution of sodium hydroxide | 15 |
| water | 10 |

In the above composition, the ratio of vinyl sulphc nate to acrylic acid was 0.45:1.

Using the formulation described above, two differen types of uranium ores were tested in a leach cycle Dosage rates were within 0.05 to 1.0 pounds per ton c ore.

Two-stage treatment was used beginning with 99 grams ore, 990 ml. $H_2O$, 120 ml. core $H_2SO_4$ giving pH of about 1.5 at ambient temperatures and a $U_3O$ head of 0.183–0.185 in original ore. The Second stag was treated with 402 ml. $H_2O$, 135 ml. $H_2SO_4$ for fou hours at 275° F. under 60 PSI using air pressure.

| Uranium Ore | % $U_3O_8$ Recovery | Free Acid | pH |
|---|---|---|---|
| Type 1 (HD = 0.185) | | | |
| Control | 89.19% | 85.4 gpl | 0.10 |
| Formulation I (0.5 lb/ton) | 91.35% | 88.1 gpl | 0.07 |
| Formulation I (0.5 lb/ton) | 91.35% | 76.2 gpl | 0.06 |
| Type 2 (HD = 0.183) | | | |
| Control | 92.90% | 99.1 gpl | 0.12 |
| Formulation I (0.5 lb/ton) | 95.08% | 101.3 gpl | 0.05 |
| Formulation I (0.5 lb/ton) | 94.54% | 96.7 gpl | 0.04 |

The tests for Type I ore gave below normal results but it is still observed that using the formulation an composition of the invention dramatically improves th recovery of $U_3O_8$ from the ore.

The tests on Type 2 uranium ore gave results fo recovery per cent much more in line with normal obser vation. It is seen that, again, the use of the formultion of this invention dramatically improves the recovery c $U_3O_8$ from the starting ores in this acid-leaching pro cess.

I claim:

1. A method of improving the acid leaching of uraium ores which comprises adding to such ores while hey are being leached between 0.01–2 lb. per ton of a omposition comprising:

a. aminotris methylene phosphonic acid, and b. a water-soluble copolymer of vinyl sulphonic acid and acrylic acid combined in a weight ratio of from 2:1 to 1:2 and having a molecular weight within the range of from 500 to 100,000, with the weight ratio of a:b being within the range of 1:2 to 2:1.

2. The method of claim 1 where the ratio of a:b is 1:1 and the ratio of acrylic acid to vinyl sulphonic acid is 1:0.45.

* * * * *